US011109164B2

(12) United States Patent
Mosgaard et al.

(10) Patent No.: US 11,109,164 B2
(45) **Date of Patent: *Aug. 31, 2021**

(54) METHOD OF OPERATING A HEARING AID SYSTEM AND A HEARING AID SYSTEM

(71) Applicant: Widex A/S, Lynge (DK)

(72) Inventors: Lars Dalskov Mosgaard, Copenhagen (DK); Thomas Bo Elmedyb, Herlev (DK); Michael Johannes Pihl, Copenhagen (DK); Georg Stiefenhofer, Hundested (DK); Jakob Nielsen, Copenhagen (DK); Adam Westermann, Copenhagen (DK)

(73) Assignee: Widex A/S, Lynge (DK)

( * ) Notice: Subject to any disclaimer, the term of this patent is extended or adjusted under 35 U.S.C. 154(b) by 0 days.

This patent is subject to a terminal disclaimer.

(21) Appl. No.: 16/760,164

(22) PCT Filed: Oct. 30, 2018

(86) PCT No.: PCT/EP2018/079674
§ 371 (c)(1),
(2) Date: Apr. 29, 2020

(87) PCT Pub. No.: WO2019/086433
PCT Pub. Date: May 9, 2019

(65) Prior Publication Data

US 2020/0359139 A1 Nov. 12, 2020

(30) Foreign Application Priority Data

Oct. 31, 2017 (DK) ..... PA201700611
Oct. 31, 2017 (DK) ..... PA201700612
(Continued)

(51) Int. Cl.
*H04R 25/00* (2006.01)

(52) U.S. Cl.
CPC ..... *H04R 25/407* (2013.01); *H04R 25/405* (2013.01); *H04R 25/505* (2013.01);
(Continued)

(58) Field of Classification Search
CPC . H04R 25/00; H04R 2225/49; H04R 2460/01
(Continued)

(56) References Cited

U.S. PATENT DOCUMENTS 6,240,192 B1 * 5/2001 Brennan ..... H04R 25/505 381/312
2002/0176594 A1 * 11/2002 Hohmann ..... H04R 25/552 381/312
(Continued)

FOREIGN PATENT DOCUMENTS

WO 2009/034524 A1 3/2009

OTHER PUBLICATIONS

Sam Karimian-Azari, et al., :"Robust DOA Estimation of Harmonic Signals Using Constrained Filters on Phase Estimates", Proceedings of the 22nd European Signal Processing Conference (EUSIPCO), Sep. 1, 2014, pp. 1930-1934.
(Continued)

*Primary Examiner* — Suhan Ni
(74) *Attorney, Agent, or Firm* — Sughrue Mion, PLLC

(57) ABSTRACT

A method of operating a hearing aid system in order to provide improved sound environment classification and a hearing aid system (200) for carrying out the method.

17 Claims, 3 Drawing Sheets

(30) Foreign Application Priority Data

Aug. 15, 2018 (DK) ..... PA201800462
Aug. 15, 2018 (DK) ..... PA201800465

(52) U.S. Cl.
CPC ..... *H04R 25/552* (2013.01); *H04R 25/554* (2013.01); *H04R 25/70* (2013.01); *H04R 2225/41* (2013.01); *H04R 2225/43* (2013.01); *H04R 2225/55* (2013.01); *H04R 2460/01* (2013.01)

(58) Field of Classification Search
USPC ..... 381/312–319
See application file for complete search history.

(56) References Cited

U.S. PATENT DOCUMENTS

2008/0167869 A1 7/2008 Nakadai et al.
2009/0202091 A1 8/2009 Pedersen et al.
2015/0245152 A1 8/2015 Ding et al.
2015/0289064 A1 10/2015 Jensen et al.
2015/0312663 A1 10/2015 Traa et al.

OTHER PUBLICATIONS

Johannes Nix et al., "Sound source localization in real sound fields based on empirical statistics of interaural parameters", The Journal of the Acoustical Society of America, Jan. 2006, pp. 463-479, vol. 119 (1).
Danish Search and Examination Report for PA 2017 00612 dated Apr. 23, 2018.
International Search Report for PCT/EP2018/079674 dated Feb. 11, 2019 (PCT/ISA/210).
Written Opinion for PCT/EP2018/079674 dated Feb. 11, 2019 (PCT/ISA/237).
Cabot , "An Introduction to Circular Statistics and its Application to Sound Localization Experiments", An Audio Engineering Society Reprint, 58th Convention, Nov. 4-7, 1977, New York, XP002788240, pp. 1-18, 20 pages total.

* cited by examiner

METHOD OF OPERATING A HEARING AID SYSTEM AND A HEARING AID SYSTEM

CROSS REFERENCE TO RELATED APPLICATIONS

This application is a National Stage of International Application No. PCT/EP2018/079674 filed Oct. 30, 2018, claiming priorities based on Danish Patent Application Nos. PA201700611 and PA201700612 filed Oct. 31, 2017 and Danish Patent Application Nos. PA201800462 and PA201800465 filed Aug. 15, 2018.

The present invention relates to a method of operating a hearing aid system. The present invention also relates to a hearing aid system adapted to carry out said method.

BACKGROUND OF THE INVENTION

Generally a hearing aid system according to the invention is understood as meaning any device which provides an output signal that can be perceived as an acoustic signal by a user or contributes to providing such an output signal, and which has means which are customized to compensate for an individual hearing loss of the user or contribute to compensating for the hearing loss of the user. They are, in particular, hearing aids which can be worn on the body or by the ear, in particular on or in the ear, and which can be fully or partially implanted. However, some devices whose main aim is not to compensate for a hearing loss, may also be regarded as hearing aid systems, for example consumer electronic devices (televisions, hi-fi systems, mobile phones, MP3 players etc.) provided they have, however, measures for compensating for an individual hearing loss.

Within the present context a traditional hearing aid can be understood as a small, battery-powered, microelectronic device designed to be worn behind or in the human ear by a hearing-impaired user. Prior to use, the hearing aid is adjusted by a hearing aid fitter according to a prescription. The prescription is based on a hearing test, resulting in a so-called audiogram, of the performance of the hearing-impaired user's unaided hearing. The prescription is developed to reach a setting where the hearing aid will alleviate a hearing loss by amplifying sound at frequencies in those parts of the audible frequency range where the user suffers a hearing deficit. A hearing aid comprises one or more microphones, a battery, a microelectronic circuit comprising a signal processor, and an acoustic output transducer. The signal processor is preferably a digital signal processor. The hearing aid is enclosed in a casing suitable for fitting behind or in a human ear.

Within the present context a hearing aid system may comprise a single hearing aid (a so called monaural hearing aid system) or comprise two hearing aids, one for each ear of the hearing aid user (a so called binaural hearing aid system). Furthermore, the hearing aid system may comprise an external device, such as a smart phone having software applications adapted to interact with other devices of the hearing aid system. Thus within the present context the term "hearing aid system device" may denote a hearing aid or an external device.

The mechanical design has developed into a number of general categories. As the name suggests, Behind-The-Ear (BTE) hearing aids are worn behind the ear. To be more precise, an electronics unit comprising a housing containing the major electronics parts thereof is worn behind the ear. An earpiece for emitting sound to the hearing aid user is worn in the ear, e.g. in the concha or the ear canal. In a traditional BTE hearing aid, a sound tube is used to convey sound from the output transducer, which in hearing aid terminology is normally referred to as the receiver, located in the housing of the electronics unit and to the ear canal. In some modern types of hearing aids, a conducting member comprising electrical conductors conveys an electric signal from the housing and to a receiver placed in the earpiece in the ear. Such hearing aids are commonly referred to as Receiver-In-The-Ear (RITE) hearing aids. In a specific type of RITE hearing aids the receiver is placed inside the ear canal. This category is sometimes referred to as Receiver-In-Canal (RIC) hearing aids.

In-The-Ear (ITE) hearing aids are designed for arrangement in the ear, normally in the funnel-shaped outer part of the ear canal. In a specific type of ITE hearing aids the hearing aid is placed substantially inside the ear canal. This category is sometimes referred to as Completely-In-Canal (CIC) hearing aids. This type of hearing aid requires an especially compact design in order to allow it to be arranged in the ear canal, while accommodating the components necessary for operation of the hearing aid.

Hearing loss of a hearing impaired person is quite often frequency-dependent. This means that the hearing loss of the person varies depending on the frequency. Therefore, when compensating for hearing losses, it can be advantageous to utilize frequency-dependent amplification. Hearing aids therefore often provide to split an input sound signal received by an input transducer of the hearing aid, into various frequency intervals, also called frequency bands, which are independently processed. In this way, it is possible to adjust the input sound signal of each frequency band individually to account for the hearing loss in respective frequency bands.

A number of hearing aid features such as beamforming, noise reduction schemes and compressor settings are not universally beneficial and preferred by all hearing aid users. Therefore detailed knowledge about a present acoustic situation is required to obtain maximum benefit for the individual user. Especially, knowledge about the number of talkers (or other target sources) present and their position relative to the hearing aid user and knowledge about the diffuse noise are relevant. Having access to this knowledge in real-time can be used to classify the general sound environment but can also be used to classify specific parts of the sound environment, both of which can be used to effectively help the user by improving performance of at least the above mentioned hearing aid features.

It is therefore a feature of the present invention to provide a method of operating a hearing aid system that provides improved sound classification.

It is another feature of the present invention to provide a hearing aid system adapted to provide such a method of operating a hearing aid system.

SUMMARY OF THE INVENTION

The invention, in a first aspect, provides a method of operating a hearing aid system comprising the steps of:

- providing a first and a second input signal, wherein the first and second input signal represent the output from a first and a second microphone respectively;
- determining at least one of an unbiased mean phase and a resultant length from samples of inter-microphone phase differences between said first and second microphone;
- using at least one of the unbiased mean phase and the resultant length to classify a sound environment.

This provides an improved method of operating a hearing aid system with respect to sound classification.

The invention, in a second aspect, provides a hearing aid comprising a first and a second microphone, a digital signal processor and an electrical-acoustical output transducer;

wherein the digital signal processor is configured to apply a frequency dependent gain that is adapted to at least one of suppressing noise and alleviating a hearing deficit of an individual wearing the hearing aid system, and;

wherein the digital signal processor is adapted to determine a multitude of samples of the inter-microphone phase difference between the first and the second acoustical-electrical input transducers, and;

wherein the digital signal processor is adapted to determine at least one of an unbiased mean phase and a resultant length from the multitude of samples of the inter-microphone phase difference, and;

wherein the digital signal processor is further adapted to use at least one of the unbiased mean phase and the resultant length to classify a sound environment.

This provides a hearing aid system with improved means for operating a hearing aid system with respect to sound classification.

The invention, in a third aspect, provides a non-transitory computer readable medium carrying instructions which, when executed by a computer, cause the following method to be performed:

- providing a first and a second input signal, wherein the first and second input signal represent the output from a first and a second microphone respectively;
- determining at least one of an unbiased mean phase and a resultant length from samples of inter-microphone phase differences between said first and second microphone;
- using at least one of the unbiased mean phase and the resultant length to classify a sound environment.

The invention in a fourth aspect provides an internet server comprising a downloadable application that may be executed by a personal communication device, wherein the downloadable application is adapted to cause the following method to be performed:

- providing a first and a second input signal that are at least derived from the output signals from a first and a second microphone respectively;
- using said first and second input signal to determine an unbiased mean phase of an inter-microphone transfer function between said first and second microphones, wherein the inter-microphone transfer function represents sound from a particular angular direction;
- using the unbiased mean phase to control a directional system.

Further advantageous features appear from the dependent claims.

Still other features of the present invention will become apparent to those skilled in the art from the following description wherein the invention will be explained in greater detail.

BRIEF DESCRIPTION OF THE DRAWINGS

By way of example, there is shown and described a preferred embodiment of this invention. As will be realized, the invention is capable of other embodiments, and its several details are capable of modification in various, obvious aspects all without departing from the invention. Accordingly, the drawings and descriptions will be regarded as illustrative in nature and not as restrictive. In the drawings.

DETAILED DESCRIPTION

In the present context the term signal processing is to be understood as any type of hearing aid system related signal processing that includes at least: beam forming, noise reduction, speech enhancement and hearing compensation.

In the present context the terms beam former and directional system may be used interchangeably.

Figure 1:
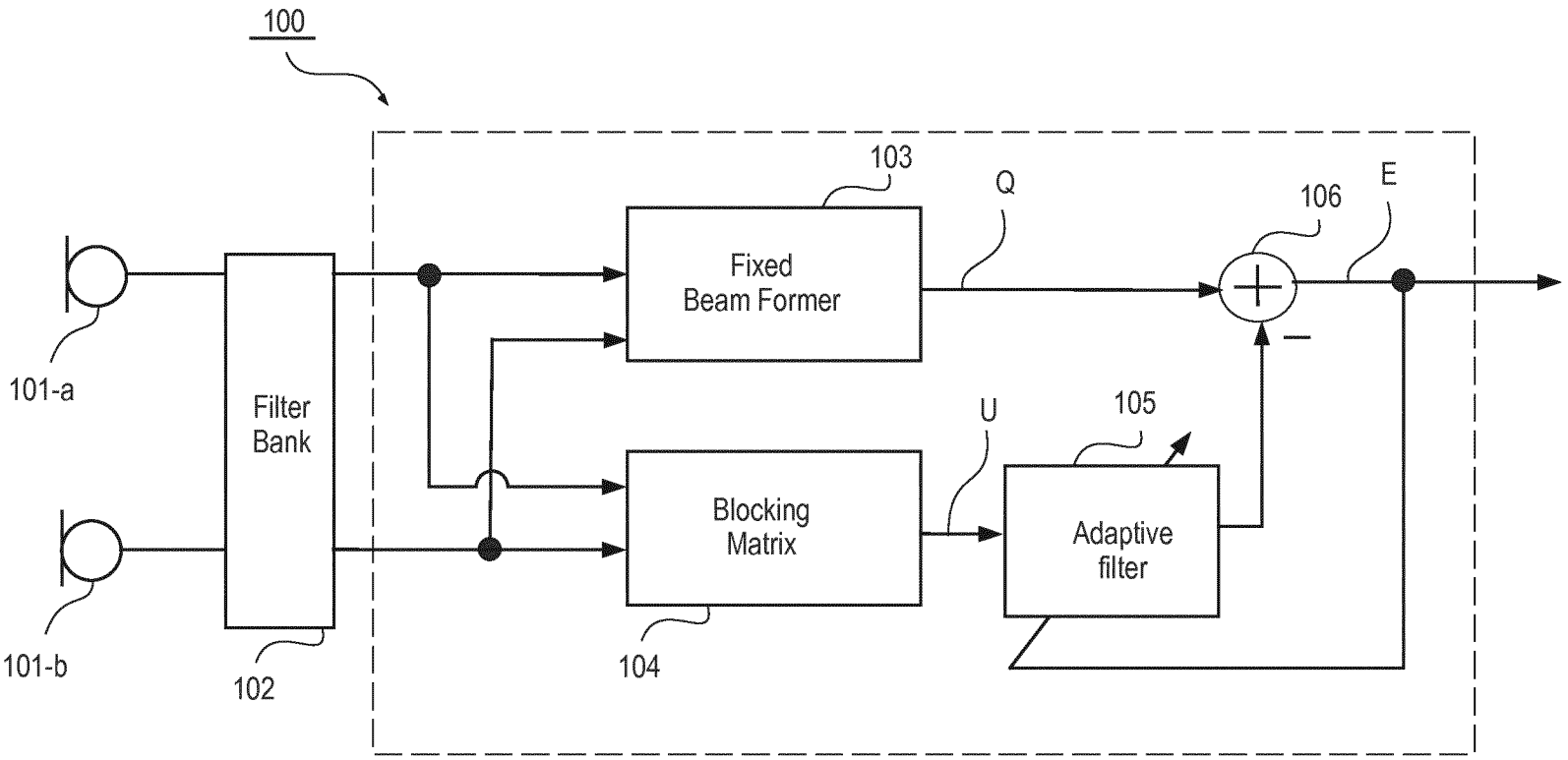
FIG. 1 illustrates highly schematically a directional system according to an embodiment of the invention.

Reference is first made to FIG. 1, which illustrates highly schematically a directional system 100 suitable for implementation in a hearing aid system according to an embodiment of the invention.

The directional system 100 takes as input, the digital output signals, at least, derived from the two acoustical-electrical input transducers 101*a-b*.

According to the embodiment of FIG. 1, the acoustical-electrical input transducers 101*a-b*, which in the following may also be denoted microphones, provide analog output signals that are converted into digital output signals by analog-digital converters (ADC) and subsequently provided to a filter bank 102 adapted to transform the signals into the time-frequency domain. One specific advantage of transforming the input signals into the time-frequency domain is that both the amplitude and phase of the signals become directly available in the provided individual time-frequency bins. According to an embodiment a Fast Fourier Transform (FFT) may be used for the transformation and in variations other time-frequency domain transformations can be used such as a Discrete Fourier Transform (DTF), a polyphase filterbank or a Discrete Cosine Transformation.

However, for reasons of clarity the ADCs are not illustrated in FIG. 1. Furthermore, in the following, the output signals from the filter bank 102 will primarily be denoted input signals because these signals represent the primary input signals to the directional system 100. Additionally the term digital input signal may be used interchangeably with the term input signal. In a similar manner all other signals referred to in the present disclosure may or may not be specifically denoted as digital signals. Finally, at least the terms input signal, digital input signal, frequency band input signal, sub-band signal and frequency band signal may be used interchangeably in the following and unless otherwise noted the input signals can generally be assumed to be frequency band signals independent on whether the filter bank 102 provide frequency band signals in the time domain or in the time-frequency domain. Furthermore, it is generally assumed, here and in the following, that the microphones 101*a-b* are omni-directional unless otherwise mentioned.

In a variation the input signals are not transformed into the time-frequency domain. Instead the input signals are first transformed into a number of frequency band signals by a time-domain filter bank comprising a multitude of time-domain bandpass filters, such as Finite Impulse Response bandpass filters and subsequently the frequency band signals are compared using correlation analysis wherefrom the phase is derived.

Both the digital input signals are branched, whereby the input signals, in a first branch, is provided to a Fixed Beam Former (FBF) unit 103, and, in a second branch, is provided to a blocking matrix 104.

In the second branch the digital input signals are provided to the blocking matrix 104 wherein an assumed or estimated target signal is removed and whereby an estimated noise signal that in the following will be denoted U may be determined from the equation:

$$U=\overline{B}^H\overline{X} \quad \text{(equation 1)}$$

Wherein the vector $\overline{X}^T=[M_1,M_2]$ holds the two (microphone) input signals and wherein the vector $\overline{B}$ represents the blocking matrix 104. The blocking matrix may be given by:

$$\overline{B}=\begin{bmatrix}-D\\1\end{bmatrix} \quad \text{(eq. 2)}$$

Wherein D is the Inter-Microphone Transfer Function (which in the following may be abbreviated IMTF) that represents the transfer function between the two microphones with respect to a specific source. In the following the IMTF may interchangeably also be denoted the steering vector.

In the first branch, which in the following also may be denoted the omni branch, the digital input signals are provided to the FBF unit 103 that provides an omni signal Q given by the equation:

$$Q=\overline{W}_0^H\overline{X} \quad \text{(eq. 3)}$$

Wherein the vector $\overline{W}_0$ represents the FBF unit 103 that may be given by:

$$\overline{W}_0=(1+DD^*)^{-1}\begin{bmatrix}1\\D^*\end{bmatrix} \quad \text{(eq. 4)}$$

It can be shown that the presented choice of the Blocking Matrix 104 and the FBF unit 103 is optimal using a least mean square (LMS) approach.

The estimated noise signal U provided by the blocking matrix 104 is filtered by the adaptive filter 105 and the resulting filtered estimated noise signal is subtracted, using the subtraction unit 106, from the omni-signal Q provided in the first branch in order to remove the noise, and the resulting beam formed signal E is provided to further processing in the hearing aid system, wherein the further processing may comprise application of a frequency dependent gain in order to alleviate a hearing loss of a specific hearing aid system user and/or processing directed at reducing noise or improving speech intelligibility.

The resulting beam formed signal E may therefore be expressed using the equation:

$$E=\overline{W}_0^H\overline{X}-H\overline{B}^H\overline{X} \quad \text{(eq. 5)}$$

Wherein H represents the adaptive filter 105, which in the following may also interchangeably be denoted the active noise cancellation filter.

The input signal vector $\overline{X}$ and the output signal E of the directional system 100 may be expressed as:

$$\overline{X}=\begin{bmatrix}X_t^{M_1}\\X_t^{M_2}\end{bmatrix}+\begin{bmatrix}X_n^{M_1}\\X_n^{M_2}\end{bmatrix}=X_t\begin{bmatrix}1\\D^*\end{bmatrix}+\begin{bmatrix}X_n^{M_1}\\X_n^{M_2}\end{bmatrix} \text{ and:} \quad \text{(eq. 6)}$$

-continued $$E=X_t+\frac{X_n^{M_1}+DX_n^{M_2}}{1+DD^*}-H\left(X_n^{M_2}-D^*X_n^{M_1}\right) \quad \text{(eq. 7)}$$

Wherein the subscript n represents noise and subscript t represents the target signal.

It follows that the second branch perfectly cancels the target signal and consequently the target signal is, under ideal conditions, fully preserved in the output signal E of the directional system 100.

It can also be shown that the directional system 100, under ideal conditions, in the LMS sense will cancel all the noise without compromising the target signal. However, it is, under realistic conditions, practically impossible to control the blocking matrix such that the target signal is completely cancelled. This results in the target signal bleeding into the estimated noise signal U, which means that the adaptive filter 105 will start to cancel the target signal. Furthermore, in a realistic environment, the blocking matrix 104 needs to also take into account not only the direct sound from a target source but also the early reflections from the target source, in order to ensure optimum performance because these early reflections may contribute to speech intelligibility. Thus if the early reflections are not suppressed by the blocking matrix 104, then these early reflections will be considered noise and the adaptive filter 105 will attempt to cancel them.

It has therefore been suggested in the art to accept that it is not possible to remove the target signal completely and a constraint is therefore put on the adaptive filter 105. However, this type of strategy for making the directional system robust against cancelling of the target signal comes at the price of a reduction in performance.

Thus, in addition to improving the accuracy of the blocking matrix with respect to suppressing a target signal, it is desirable to be able to estimate the accuracy of the blocking matrix 104 and also the nature of the spatial sound in order to be able to make a conscious trade-off between beam forming performance and robustness.

According to the present invention this may be achieved by considering the IMTF for a given target sound source. For the estimation of the IMTF the properties of periodic variables need to be considered. In the following, periodic variables will due to mathematically convenience be described as complex numbers. An estimate of the IMTF for a given target sound source may therefore be given as a complex number that in polar representation has an amplitude A and a phase θ. The average of a multitude of IMTF estimates may be given by:

$$\langle Ae^{-i\theta}\rangle=\frac{1}{n}\sum_{i=1}^{n}A_ie^{-i\theta_i}=R_Ae^{-i\hat{\theta}_A} \quad \text{(eq. 8)}$$

Wherein ⟨ ⟩ is the average operator, n represents the number of IMTF estimates used for the averaging, RA is an averaged amplitude that depends on the phase and that may assume values in the interval [0, ⟨A⟩], and $\hat{\theta}_A$ is the weighted mean phase. It can be seen that the amplitude A of each individual sample weight each corresponding phase $\theta_i$ in the averaging. Therefore both the averaged amplitude RA and the weighted mean phase $\hat{\theta}_A$ are biased (i.e. dependent on the other).

It is noted that the present invention is independent of the specific choice of statistical operator used to determine an average, and consequently within the present context the terms expectation operator, average or sample mean may be used to represent the result of statistical functions or operators selected from a group comprising the Boxcar function. In the following these terms may therefore be used interchangeably.

The amplitude weighting providing the weighted mean phase $\hat{\theta}_A$ will generally result in the weighted mean phase $\hat{\theta}_A$ being different from the unbiased mean phase $\hat{\theta}$ that is defined by:

$$\langle e^{-i\theta}\rangle = \frac{1}{n}\sum_{i=1}^{n} e^{-i\theta_i} = Re^{-i\hat{\theta}} \quad \text{(eq. 9)}$$

As in equation (8) $\langle\rangle$ is the average operator and n represents the number of inter-microphone phase difference samples used for the averaging. It follows that the unbiased mean phase $\hat{\theta}$ can be estimated by averaging a multitude of inter-microphone phase difference samples. R is denoted the resultant length and the resultant length R provides information on how closely the individual phase estimates $\theta_i$ are grouped together and the circular variance V and the resultant length R are related by:

$$V=1-R \quad \text{(eq. 10)}$$

The inventors have found that the information regarding the amplitude relation, which is lost in the determination of the unbiased mean phase $\hat{\theta}$, the resultant length R and the circular variance V turns out to be advantageous because more direct access to the underlying phase probability distribution is provided.

Considering again the directional system 100 described above the optimum steering vector D* may be given by:

$$\frac{d\left(\mathbb{E}\left(\begin{pmatrix} M_2(f) - \\ D(f)M_1(f)\end{pmatrix}\begin{pmatrix} M_2^*(f) - \\ D^*(f)M_1^*(f)\end{pmatrix}\right)\right)}{dD^*} = \quad \text{(eq. 11)}$$

$$0 \Rightarrow D(f) = \frac{\mathbb{E}(M_2(f)M_1^*(f))}{\mathbb{E}(|M_1(f)|^2)};$$

Wherein $\mathbb{E}$ is the expectation operator.

It is noted that the optimal estimate of the IMTF in the LMS sense is closely related to the coherence C(f) that may be given as:

$$C(f) = \frac{|D(f)|^2}{\frac{E(|M_2(f)|^2)}{E(|M_1(f)|^2)}} = \frac{|\mathbb{E}(M_2(f)M_1^*(f))|^2}{\mathbb{E}(|M_2(f)|^2)\mathbb{E}(|M_1(f)|^2)} \quad \text{(eq. 12)}$$

It is noted that the derived expression for the optimal IMTF, using the least mean square approach, is subject to bias problems both in the estimation of the phase and amplitude relation because the averaged amplitude is phase dependent and the weighted mean phase is amplitude dependent, both of which is undesirable. This however is the strategy for estimating the IMTF commonly taken.

The present invention provides an alternative method of estimating the phase of the steering vector which is optimal in the LMS sense, when the normalized input signals are considered as opposed to the input signals considered alone. In the following this optimal steering vector based on normalized input signals will be denoted $D_N(f)$:

$$\frac{d\left(\mathbb{E}\left(\begin{pmatrix} \left(\frac{M_2(f)}{|M_2(f)|} - D_N(f)\frac{M_1(f)}{|M_1(f)|}\right) \\ \left(\frac{M_2^*(f)}{|M_2(f)|} - D_N^*(f)\frac{M_1^*(f)}{|M_1(f)|}\right)\end{pmatrix}\right)\right)}{dD_N^*} = \quad \text{(eq. 13)}$$

$$0 \Rightarrow D_N(f) = \mathbb{E}\left(\frac{M_2(f)M_1^*(f)}{|M_2(f)||M_1(f)|}\right) = Re^{-i\hat{\theta}}$$

It follows that by using this LMS optimization according to an embodiment of the present invention, then access to the "correct" phase, in the form of the unbiased mean phase $\hat{\theta}$ and to the variance V (derivable directly from the resultant length R using equation 10), is obtained at the cost of losing the information concerning the amplitude part of the IMTF.

However, according to an embodiment the amplitude part is estimated simply by selecting at least one set of input signals that has contributed to providing a high value of the resultant length, wherefrom it may be assumed that the input signals are not primarily noise and that therefore the biased mean amplitude corresponding to said set of input signals is relatively accurate. Furthermore the value of unbiased mean phase can be used to select between different target sources.

According to yet another, and less advantageous variation the biased mean amplitude is used to control the directional system without considering the corresponding resultant length.

According to another variation the amplitude part is determined by transforming the unbiased mean phase using a transformation selected from a group comprising the Hilbert transformation.

Thus having improved estimations of the amplitude and phase of the IMTF a directional system with improved performance is obtained. The method has been disclosed in connection with a Generalized Sidelobe Canceller (GSC) design, but may in variations also be applied to improve performance of other types of directional systems such as a multi-channel Wiener filter, a Minimum Mean Squared Error (MMSE) system and a Linearly Constrained Minimum Variance (LCMV) system. However, the method may also be applied for directional system that is not based on energy minimization.

Generally, it is worth appreciating that the determination of the amplitude and phase of the IMTF according to the present invention can be determined purely based on input signals and as such is highly flexible with respect to its use in various different directional systems.

It is noted that the approach of the present invention, despite being based on LMS optimization of normalized input signals, is not the same as the well known Normalized Least Mean Square (NLMS) algorithm, which is directed at improving the convergence properties.

For the IMTF estimation strategy to be robust in realistic dynamic sound environments it is generally preferred that the input signals (i.e. the sound environment) can be considered quasi stationary. The two main sources of dynamics are the temporal and spatial dynamics of the sound environment. For speech the duration of a short consonant may be as short as only 5 milliseconds, while long vowels may have a duration of up to 200 milliseconds depending on the specific sound. The spatial dynamics is a consequence of relative movement between the hearing aid user and surrounding sound sources. As a rule of thumb speech is considered quasi stationary for a duration in the range between say 20 and 40 milliseconds and this includes the impact from spatial dynamics.

For estimation accuracy, it is generally preferable that the duration of the involved time windows are as long as possible, but it is, on the other hand, detrimental if the duration is so long that it covers natural speech variations or spatial variations and therefore cannot be considered quasi-stationary.

According to an embodiment of the present invention a first time window is defined by the transformation of the digital input signals into the time-frequency domain and the longer the duration of the first time window the higher the frequency resolution in the time-frequency domain, which obviously is advantageous. Additionally, the present invention requires that the determination of an unbiased mean phase or the resultant length of the IMTF for a particular angular direction or the final estimate of an inter-microphone phase difference is based on a calculation of an expectation value and it has been found that the number of individual samples used for calculation of the expectation value preferably exceeds at least 5.

According to a specific embodiment the combined effect of the first time window and the calculation of the expectation value provides an effective time window that is shorter than 40 milliseconds or in the range between 5 and 200 milliseconds such that the sound environment in most cases can be considered quasi-stationary.

According to a variation improved accuracy of the unbiased mean phase or the resultant length may be provided by obtaining a multitude of successive samples of the unbiased mean phase and the resultant length, in the form of a complex number using the methods according to the present invention and subsequently adding these successive estimates (i.e. the complex numbers) and normalizing the result of the addition with the number of added estimates. This embodiment is particularly advantageous in that the resultant length effectively weights the samples that have a high probability of comprising a target source, while estimates with a high probability of mainly comprising noise will have a negligible impact on the final value of the unbiased mean phase of the IMTF or inter-microphone phase difference because the samples are characterized by having a low value of the resultant length. Using this method it therefore becomes possible to achieve pseudo time windows with a duration up to say several seconds or even longer and the improvements that follows therefrom, despite the fact that neither the temporal nor the spatial variations can be considered quasi-stationary.

In a variation at least one or at least not all of the successive complex numbers representing the unbiased mean phase and the resultant length are used for improving the estimation of the unbiased mean phase of the IMTF or inter-microphone phase difference, wherein the selection of the complex numbers to be used are based on an evaluation of the corresponding resultant length (i.e. the variance) such that only complex numbers representing a high resultant length are considered.

According to another variation the estimation of the unbiased mean phase of the IMTF or inter-microphone phase difference is additionally based on an evaluation of the value of the individual samples of the unbiased mean phase such that only samples representing the same target source are combined.

According to yet another variation speech detection may be used as input to determine a preferred unbiased mean phase for controlling a directional system, e.g. by giving preference to target sources positioned at least approximately in front of the hearing aid system user, when speech is detected. In this way it may be avoided that a directional system enhances the direct sound from an undesired source.

According to still another embodiment monitoring of the unbiased mean phase and the corresponding variance may be used for speech detection either alone or in combination with traditional speech detection methods, such as the methods disclosed in WO-A1-2012076045. The basic principle of this specific embodiment being that an unbiased mean phase estimate with a low variance is very likely to represent a sound environment with a single primary sound source. However, since a single primary sound source may be single speaker or something else such as a person playing music it will be advantageous to combine the basic principle of this specific embodiment with traditional speech detection methods based on e.g. the temporal or level variations or the spectral distribution.

According to an embodiment the angular direction of a target source, which may also be denoted the direction of arrival (DOA) is derived from the unbiased mean phase and used for various types of signal processing.

As one specific example, the resultant length can be used to determine how to weight information, such as a determined DOA of a target source, from each hearing aid of a binaural hearing aid system.

More generally the resultant length can be used to compare or weight information obtained from a multitude of microphone pairs, such as the multitude of microphone pairs that are available in e.g. a binaural hearing aid system comprising two hearing aids each having two microphones.

According to a specific embodiment the determination of a an angular direction of a target source is provided by combining a monaurally determined unbiased mean phase with a binaurally determined unbiased mean phase, whereby the symmetry ambiguity that results when translating an estimated phase to a target direction may be resolved.

Figure 2:
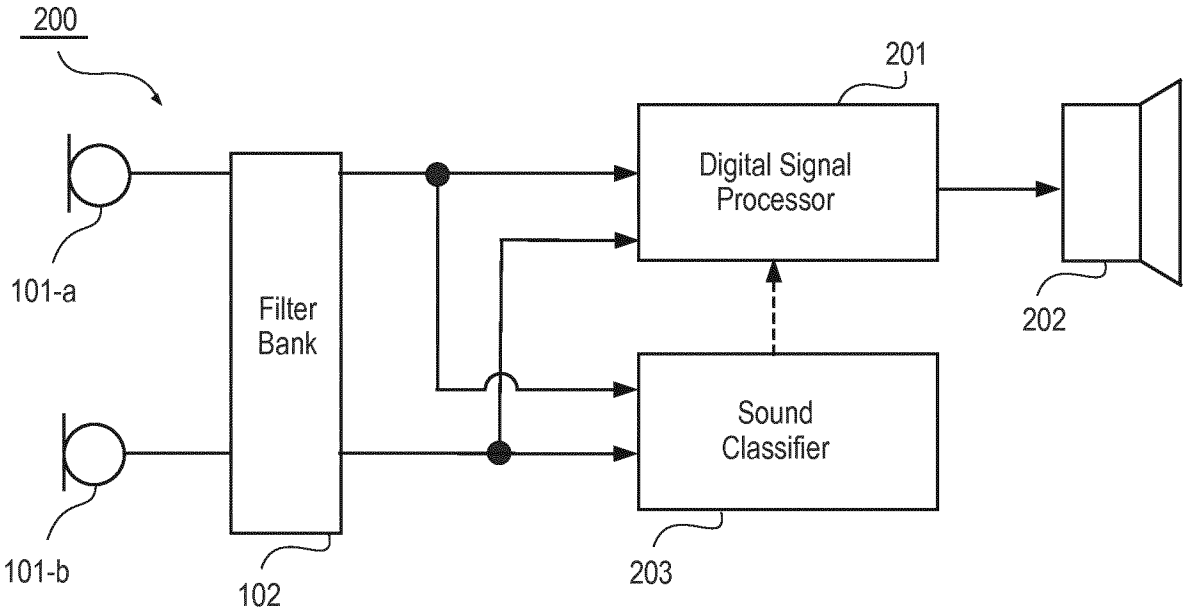
FIG. 2 illustrates highly schematically a hearing aid system according to an embodiment of the invention.

Reference is now made to FIG. 2, which illustrates highly schematically a hearing aid system 200 according to an embodiment of the invention. The components that have already been described with reference to FIG. 1 are given the same numbering as in FIG. 1.

The hearing aid system 200 comprises a first and a second acoustical-electrical input transducers 101*a-b*, a filter bank 102, a digital signal processor 201, an electrical-acoustical output transducer 202 and a sound classifier 203.

According to the embodiment of FIG. 2, the acoustical-electrical input transducers 101*a-b*, which in the following may also be denoted microphones, provide analog output signals that are converted into digital output signals by analog-digital converters (ADC) and subsequently provided to a filter bank 102 adapted to transform the signals into the time-frequency domain. One specific advantage of transforming the input signals into the time-frequency domain is that both the amplitude and phase of the signals become directly available in the provided individual time-frequency bins.

In the following the first and second input signals and the transformed first and second input signals may both be denoted input signals. The input signals 101-*a* and 101-*b* are branched and provided both to the digital signal processor 201 and to a sound classifier 203. The digital signal processor 201 may be adapted to provide various forms of signal processing including at least: beam forming, noise reduction, speech enhancement and hearing compensation.

The sound classifier 203 is configured to classify the current sound environment of the hearing aid system 200 and provide sound classification information to the digital signal processor such that the digital signal processor can operate dependent on the current sound environment.

Figure 3:
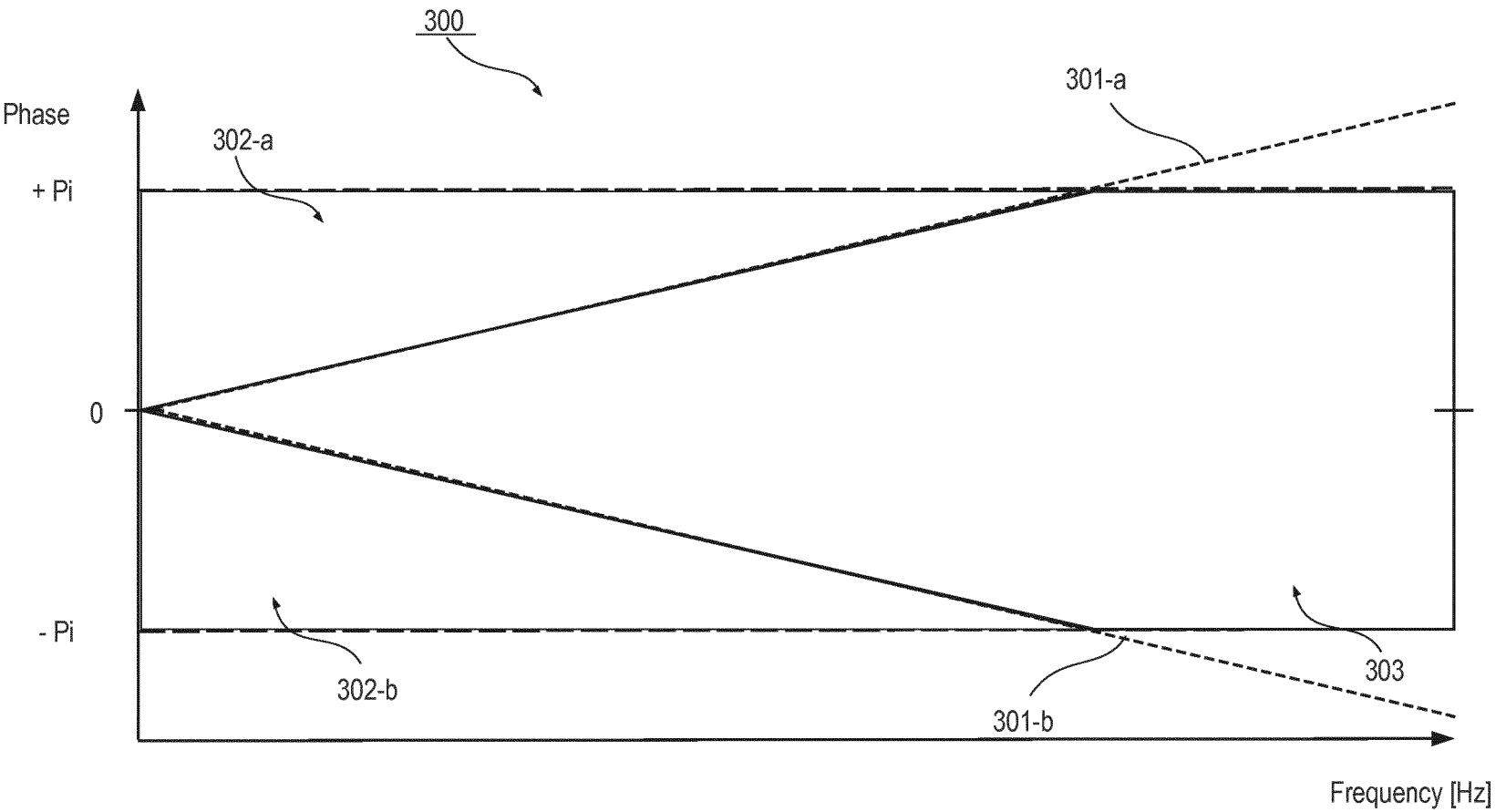
FIG. 3 illustrates highly schematically a phase versus frequency plot.

Reference is now made to FIG. 3, which illustrates highly schematically a map of values of the unbiased mean phase as a function of frequency in order to provide a phase versus frequency plot.

According to an embodiment of the present invention the phase versus frequency plot can be used to identify a direct sound if said mapping provides a straight line or at least a continuous curve in the phase versus frequency plot.

It is noted that the term "identifying" above and in the following is used interchangeably with the term "classifying".

Assuming free field a direct sound will provide a straight line in the plot, but in the real world conditions a non-straight curve will result, which will primarily be determined by the head related transfer function of the user wearing the hearing aid system and the mechanical design of the hearing aid system itself. Assuming free field the curve 301-A represents direct sound from a target positioned directly in front of the hearing aid system user assuming a contemporary standard hearing aid having two microphones positioned along the direction of the hearing aid system users nose. Correspondingly the curve 301-B represents direct sound from a target directly behind the hearing aid system user.

Generally, the angular direction of the direct sound from a given target source may be determined from the fact that the slope of the interpolated straight line representing the direct sound is given as:

$$\frac{\partial\theta}{\partial f} = \frac{2\pi d}{c} \qquad \text{(eq. 14)}$$

Wherein d represent the distance between the microphone, c is the speed of sound.

According to an embodiment of the present invention the phase versus frequency plot can be used to identify a diffuse noise field if said mapping provides a uniform distribution, for a given frequency, within a coherent region, wherein the coherent region 303 is defined as the area in the phase versus frequency plot that is bounded by the at least continuous curves defining direct sounds coming directly from the front and the back direction respectively and the curves defining a constant phase of $+\pi$ and $-\pi$ respectively.

According to another embodiment of the present invention the phase versus frequency plot can be used to identify a random or incoherent noise field if said mapping provides a uniform distribution, for a given frequency, within a full phase region defined as the area in the phase versus frequency plot that is bounded by the two straight lines defining a constant phase of $+\pi$ and $-\pi$ respectively. Thus any data points outside the coherent region, i.e. inside the incoherent regions 302-*a* and 302-*b* will represent a random or incoherent noise field.

According to a variation a diffuse noise can be identified by in a first step transforming a value of the resultant length to reflect a transformation of the unbiased mean phase from inside the coherent region and onto the full phase region, and in a second step identifying a diffuse noise field if the transformed value of the resultant length, for at least one frequency range, is below a transformed resultant length diffuse noise trigger level. More specifically the step of transforming the values of the resultant length to reflect a transformation of the unbiased mean phase from inside the coherent region and onto the full phase region comprises the step of determining the values in accordance with the formula:

$$R_{transformed} = \left| E\left( \left( \frac{M_2(f)M_1^*(f)}{|M_1(f)||M_2(f)|} \right)^{c/2df} \right) \right|$$

wherein $M_1(f)$ and $M_2(f)$ represent the frequency dependent first and second input signals respectively.

According to other embodiments identification of a diffuse, random or incoherent noise field can be made if a value of the resultant length, for at least one frequency range, is below a resultant length noise trigger level.

Similarly identification of a direct sound can be made if a value of the resultant length, for at least one frequency range, is above a resultant length direct sound trigger level.

According to still further embodiments the resultant length may be used to: estimate the variance of a correspondingly determined unbiased mean phase from samples of inter-microphone phase differences, and evaluate the validity of a determined unbiased mean phase based on the estimated variance for the determined unbiased mean phase.

In variations the trigger levels are replaced by a continuous function, which maps the resultant length or the unwrapped resultant length to a signal-to-noise-ratio, wherein the noise may be diffuse or incoherent.

In another variation improved accuracy of the determined unbiased mean phase is achieved by at least one of averaging and fitting a multitude of determined unbiased mean phases across at least one of time and frequency by weighting the determined unbiased mean phases with the correspondingly determined resultant length.

In yet another variation the resultant length may be used to perform hypothesis testing of probability distributions for a correspondingly determined unbiased mean phase.

According to another advantageous embodiment corresponding values, in time and frequency, of the unbiased mean phase and the resultant length can be used to identify and distinguish between at least two target sources, based on identification of direct sound comprising at least two different values of the unbiased mean phase.

According to yet another advantageous embodiment corresponding values, in time and frequency, of the unbiased mean phase and the resultant length can be used to estimate whether a distance to a target source is increasing or decreasing based on whether the value of the resultant length is decreasing or increasing respectively. This can be done because the reflections, at least while being indoors in say some sort of room will tend to dominate the direct sound, when the target source moves away from the hearing aid system user. This can be very advantageous in the context of beam former control because speech intelligibility can be improved by allowing at least the early reflections to pass through the beam former.

In further variations the methods and selected parts of the hearing aid according to the disclosed embodiments may also be implemented in systems and devices that are not hearing aid systems (i.e. they do not comprise means for compensating a hearing loss), but nevertheless comprise both acoustical-electrical input transducers and electro-acoustical output transducers. Such systems and devices are at present often referred to as hearables. However, a headset is another example of such a system.

According to yet other variations, the hearing aid system needs not comprise a traditional loudspeaker as output transducer. Examples of hearing aid systems that do not comprise a traditional loudspeaker are cochlear implants, implantable middle ear hearing devices (IMEHD), bone-anchored hearing aids (BAHA) and various other electro-mechanical transducer based solutions including e.g. systems based on using a laser diode for directly inducing vibration of the eardrum.

Generally the various embodiments of the present embodiment may be combined unless it is explicitly stated that they cannot be combined. Especially it may be worth pointing to the possibilities of impacting various hearing aid system signal processing features, including directional systems, based on sound environment classification.

In still other variations a non-transitory computer readable medium carrying instructions which, when executed by a computer, cause the methods of the disclosed embodiments to be performed.

Other modifications and variations of the structures and procedures will be evident to those skilled in the art.

The invention claimed is:

1. A method of operating a hearing aid system comprising the steps of:

providing a first and a second input signal, wherein the first and second input signal represent the output from a first and a second microphone respectively;

determining at least one of an unbiased mean phase and a resultant length from samples of inter-microphone phase differences between said first and second microphone;

using at least one of the unbiased mean phase and the resultant length to classify a sound environment.

2. The method according to claim 1, wherein the step of providing a first and a second input signal comprises the steps of:

transforming the input signals from a time domain representation and into a time-frequency domain representation;

providing the individual values of the input signals, in the time-frequency domain, as complex numbers representing the amplitude and the phase of individual time-frequency bins.

3. The method according to claim 1, wherein the step of determining at least one of an unbiased mean phase and a resultant length from samples of inter-microphone phase differences between said first and second microphone comprises the steps of:

determining the product of a first amplitude normalized time-frequency bin of the first input signal and a second amplitude normalized time-frequency bin of the second input signal, wherein the same point in time and frequency is considered for the first and second time-frequency bins;

determining the average of the product;

determining the unbiased mean phase as the argument of the average of the product: and determining the resultant length as the amplitude of the average of the product.

4. The method according to claim 1, wherein the step of determining at least one of an unbiased mean phase and a resultant length from samples of inter-microphone phase differences between said first and second microphone comprises the steps of:

determining the unbiased mean phase as the argument of a complex number representing a sample mean of inter-microphone phase differences between said first and second microphone, and;

determining the resultant length as the amplitude of a complex number representing a sample mean of inter-microphone phase differences between said first and second microphone.

5. The method according to claim 1, wherein the step determining at least one of an unbiased mean phase and a resultant length from samples of inter-microphone phase differences between said first and second microphone comprises the steps of:

determining a complex value $Re^{i\hat{\theta}}$, given by:

$$Re^{i\hat{\theta}} = \frac{1}{n}\sum_{i=1}^{n} e^{i\theta_i}$$

wherein n represents the number of inter-microphone phase differences used for the averaging, wherein $e^{i\theta_i}$ represents samples of inter-microphone phase differences, wherein R represents the resultant length and wherein $\hat{\theta}$ represents the unbiased mean phase.

6. The method according to claim 1, wherein the step of using at least one of the unbiased mean phase and the resultant length to classify a sound environment comprises the steps of:

mapping a multitude of successive values of the unbiased mean phase as a function of frequency in order to provide a phase versus frequency plot;

identifying at least one of:

a direct sound if said mapping provides a straight line or at least a continuous curve in the phase versus frequency plot, and a diffuse noise field if said mapping provides a uniform distribution, for a given frequency, within a coherent region, wherein the coherent region is defined as the area in the phase versus frequency plot that is bounded by the at least continuous curves defining direct sounds coming respectively from the front and back direction and also bounded by the upper and lower limits given by the two straight lines defining a constant phase of $+\pi$ and $-\pi$ respectively, and a random or incoherent noise field if said mapping provides a uniform distribution, for a given frequency, within a full phase region defined as the area in the phase versus frequency plot that is bounded by the two straight lines defining a constant phase of $+\pi$ and $-\pi$ respectively.

7. The method according to claim 6, comprising the steps of:

transforming the values of the unbiased mean phase from inside the coherent region and onto the full phase region;

identifying a diffuse noise field if mapping of the transformed values of the unbiased mean phase provides a uniform distribution, for a given frequency, within the full phase region.

8. The method according to claim 6, comprising the steps of:

transforming a value of the resultant length to reflect a transformation of the unbiased mean phase from inside the coherent region and onto the full phase region;

identifying a diffuse noise field if the transformed value of the resultant length, for at least one frequency range, is below a transformed resultant length diffuse noise trigger level.

9. The method according to claim 8, wherein the step of transforming the values of the resultant length to reflect a transformation of the unbiased mean phase from inside the coherent region and onto the full phase region comprises the step of determining the values in accordance with the formula:

$$R_{transformed} = \left| E\left( \left( \frac{M_2(f) M_1^*(f)}{|M_1(f)||M_2(f)|} \right)^{c/2df} \right) \right|$$

wherein $M_1(f)$ and $M_2(f)$ represent the frequency dependent first and second input signals respectively.

10. The method according to claim 1, wherein the step of using at least one of the unbiased mean phase and the resultant length to classify a sound environment comprises the steps of:

identifying at least one of:

a diffuse, random or incoherent noise field if a value of the resultant length, for at least one frequency range, is below a resultant length noise trigger level, and;

a direct sound if a value of the resultant length, for at least one frequency range, is above a resultant length direct sound trigger level.

11. The method according to claim 1 comprising the further steps of using the resultant length to at least one of:

estimating the variance of a determined unbiased mean phase from samples of inter-microphone phase differences between said first and second microphone, and;

evaluating the validity of a determined unbiased mean phase based on the estimated variance for the determined unbiased mean phase, and;

averaging or fitting a multitude of determined unbiased mean phases across at least one of time and frequency by weighting the determined unbiased mean phases with the correspondingly determined resultant length, and;

performing hypothesis testing of probability distributions for a correspondingly determined unbiased mean phase.

12. The method according to claim 1 comprising the further step of:

using corresponding values, in time and frequency, of the unbiased mean phase and the resultant length to identify and distinguish between at least two target sources, based on identification of direct sound comprising at least two different values of the unbiased mean phase.

13. The method according to claim 1 comprising the further step of:

using corresponding values, in time and frequency, of the unbiased mean phase and the resultant length to estimate whether a distance to a target source is increasing or decreasing based on whether the value of the resultant length is decreasing or increasing respectively.

14. A hearing aid system comprising a first and a second microphone, a digital signal processor and an electrical-acoustical output transducer;

wherein the digital signal processor is configured to apply a frequency dependent gain that is adapted to at least one of suppressing noise and alleviating a hearing deficit of an individual wearing the hearing aid system, and;

wherein the digital signal processor is adapted to determine a multitude of samples of the inter-microphone phase difference between the first and the second acoustical-electrical input transducers, and;

wherein the digital signal processor is adapted to determine at least one of an unbiased mean phase and a resultant length from the multitude of samples of the inter-microphone phase difference, and;

wherein the digital signal processor is further adapted to use at least one of the unbiased mean phase and the resultant length to classify a sound environment.

15. The hearing aid system according to claim 14, comprising a filter bank configured to provide frequency dependent input signals from the output of the first and the second acoustical-electrical input transducers whereby frequency dependent inter-microphone phase differences can be provided based on the frequency dependent input signals.

16. A non-transitory computer readable medium carrying instructions which, when executed by a computer, cause the following method to be performed:

providing a first and a second input signal, wherein the first and second input signal represent the output from a first and a second microphone respectively;

determining at least one of an unbiased mean phase and a resultant length from samples of inter-microphone phase differences between said first and second microphone;

using at least one of the unbiased mean phase and the resultant length to classify a sound environment.

17. An internet server comprising a downloadable application that may be executed by a personal communication device, wherein the downloadable application is adapted to cause the following method to be performed:

providing a first and a second input signal, wherein the first and second input signal represent the output from a first and a second microphone respectively;

determining at least one of an unbiased mean phase and a resultant length from samples of inter-microphone phase differences between said first and second microphone;

using at least one of the unbiased mean phase and the resultant length to classify a sound environment.

* * * * *